US010354486B2

(12) United States Patent
Harvie et al.

(10) Patent No.: US 10,354,486 B2
(45) **Date of Patent: *Jul. 16, 2019**

(54) UNIFIED GAMING MACHINE AND METHOD OF USE

(71) Applicant: VIDEO GAMING TECHNOLOGIES, INC., Franklin, TN (US)

(72) Inventors: William Harvie, Franklin, TN (US); Christopher Rowe, Franklin, TN (US)

(73) Assignee: VIDEO GAMING TECHNOLOGIES, INC., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/123,602

(22) Filed: Sep. 6, 2018

(65) Prior Publication Data

US 2019/0005766 A1 Jan. 3, 2019

Related U.S. Application Data

(63) Continuation of application No. 14/956,233, filed on Dec. 1, 2015, now Pat. No. 10,078,937.

(51) Int. Cl.
*G07F 17/32* (2006.01)

(52) U.S. Cl.
CPC ..... *G07F 17/3225* (2013.01); *G07F 17/3209* (2013.01); *G07F 17/329* (2013.01); *G07F 17/3211* (2013.01); *G07F 17/3246* (2013.01); *G07F 17/3248* (2013.01)

(58) Field of Classification Search
USPC ..... 463/16
See application file for complete search history.

(56) References Cited

U.S. PATENT DOCUMENTS

| | | | | |
|---|---|---|---|---|
| 8,133,133 | B2 | 3/2012 | Nguyen et al. | |
| 8,376,843 | B2 * | 2/2013 | Nguyen | G07F 17/32 463/16 |
| 8,657,679 | B2 | 2/2014 | Nguyen et al. | |
| 2007/0202941 | A1 * | 8/2007 | Miltenberger | G07F 17/32 463/25 |
| 2016/0019746 | A1 * | 1/2016 | Lyons | G07F 17/3211 463/25 |
| 2017/0124812 | A1 * | 5/2017 | Washington | G07F 17/3295 |
| 2017/0270743 | A1 * | 9/2017 | Guerrero | G07F 17/34 |
| 2017/0287267 | A1 * | 10/2017 | Lyons | G07F 17/3225 |

* cited by examiner

*Primary Examiner* — Pierre E Elisca
(74) *Attorney, Agent, or Firm* — Armstrong Teasdale LLP

(57) ABSTRACT

A gaming machine is provided, including a display, a credit input device, a non-transitory memory, and a processor. The display is configurable to selectively present a centrally determined game and a non-centrally determined game. The credit input device is used to establish a credit balance for wagering on the centrally determined game and the non-centrally determined game. The non-transitory memory stores a centrally determined game engine and a non-centrally determined game engine. The processor is coupled to the non-transitory memory and the display, and is configured to select a game engine from the centrally determined game engine and the non-centrally determined game engine, and execute the selected game engine and a corresponding game.

20 Claims, 7 Drawing Sheets

UNIFIED GAMING MACHINE AND METHOD OF USE

CROSS-REFERENCE TO RELATED APPLICATIONS

This application is a continuation of U.S. patent application Ser. No. 14/956,233, filed Dec. 1, 2015, the entire contents and disclosure of which are hereby incorporated by reference in their entirety.

BACKGROUND

The embodiments described herein relate generally to gaming systems and methods that present centrally determined and non-centrally determined games and, more particularly, to a unified gaming machine that is configurable to present both centrally determined and non-centrally determined games.

Conventionally, many Class II game systems conduct a wagering game based on a bingo game or a bingo-like game. Class II bingo-like games include pull-tab games, lotteries, punch boards, tip jars, and instant bingo, among others. In a bingo-based wagering game, a game system provides a bingo card to a player in exchange for a wager. The bingo card is typically generated at random and is evaluated against a randomly-drawn ball call. The evaluation determines whether the player wins and, if so, determines a payout. Class III games include traditional non-bingo-based casino games, such as, for example, slot machines, blackjack, roulette, and craps, among others. Legal definitions of gaming classes I, II, and III are found in the Indian Gaming Regulatory Act of 1988, section 2703 (25 U.S.C. § 2703).

In certain game systems, although a bingo game is the basis for the wagering game, the presentation of the wagering game to the player varies greatly with respect to a traditional bingo game. For example, certain game systems present the wagering game and results as a reel-based slot machine, where winning patterns on a given bingo card are displayed as winning patterns on the reels of the slot machine. Such a presentation leverages the appeal of slot machines to players, while remaining in a Class II gaming environment.

The distinction between Class II and Class III games is particularly relevant in Native American casinos, where Class II games are permitted, but operation of Class III games is generally limited and require permission from the state in which the casino is located (e.g., tribal-state compact). Class II and Class III games are conventionally manufactured in distinct gaming machines. As a result, casinos desiring to operate Class III machines in addition to Class II machines traditionally must have both types of machines on the gaming floor.

BRIEF DESCRIPTION

In one aspect, a gaming machine is provided. The gaming machine includes a display, a credit input device, a non-transitory memory, and a processor. The display is configurable to selectively present a centrally determined game and a non-centrally determined game. The credit input device is used to establish a credit balance for wagering on the centrally determined game and the non-centrally determined game. The non-transitory memory stores a centrally determined game engine and a non-centrally determined game engine. The processor is coupled to the non-transitory memory and the display, and is configured to select a game engine from the centrally determined game engine and the non-centrally determined game engine, and execute the selected game engine and a corresponding game.

In another aspect a method of presenting a wagering game on a gaming machine is provided. The method includes booting the gaming machine from a non-transitory memory. The method includes executing a centrally determined game engine on the gaming machine for determining outcomes of a centrally determined game. The method includes executing a non-centrally determined game engine on the gaming machine for determining outcomes of a non-centrally determined game. The method includes receiving a credit balance, from a credit input device on the gaming machine, from which a centrally determined wager is accepted for the centrally determined game, and from which a non-centrally determined wager is accepted for the non-centrally determined game. The method includes determining an award for the centrally determined game based on the centrally determined wager and an outcome determined by the centrally determined game engine. The method includes determining another award for the non-centrally determined game based on the non-centrally determined wager and another outcome determined by the non-centrally determined game engine.

In yet another aspect, a server for configuring a gaming machine is provided. The server includes a non-transitory memory and a processor. The non-transitory memory is configured to store a centrally determined game engine and a non-centrally determined game engine. The processor is coupled to the non-transitory memory, and is configured to boot the gaming machine. The processor is further configured to load the centrally determined game engine to the gaming machine. The processor is further configured to load the non-centrally determined game engine to the gaming machine.

In yet another aspect, a gaming machine is provided. The gaming machine includes a display, a credit input device, a non-transitory memory, and a processor. The display is configurable to selectively present a Class II game and a Class III game. The credit input device is used to establish a credit balance for wagering on the Class II game and the Class III game. The non-transitory memory stores a Class II game engine and a Class III game engine. The processor is coupled to the non-transitory memory and the display, and is configured to select a game engine from the Class II game engine and the Class III game engine, and execute the selected game engine and a corresponding game.

BRIEF DESCRIPTION OF THE DRAWINGS

The embodiments described herein may be better understood by referring to the following description in conjunction with the accompanying drawings.

DETAILED DESCRIPTION

Figure 1:
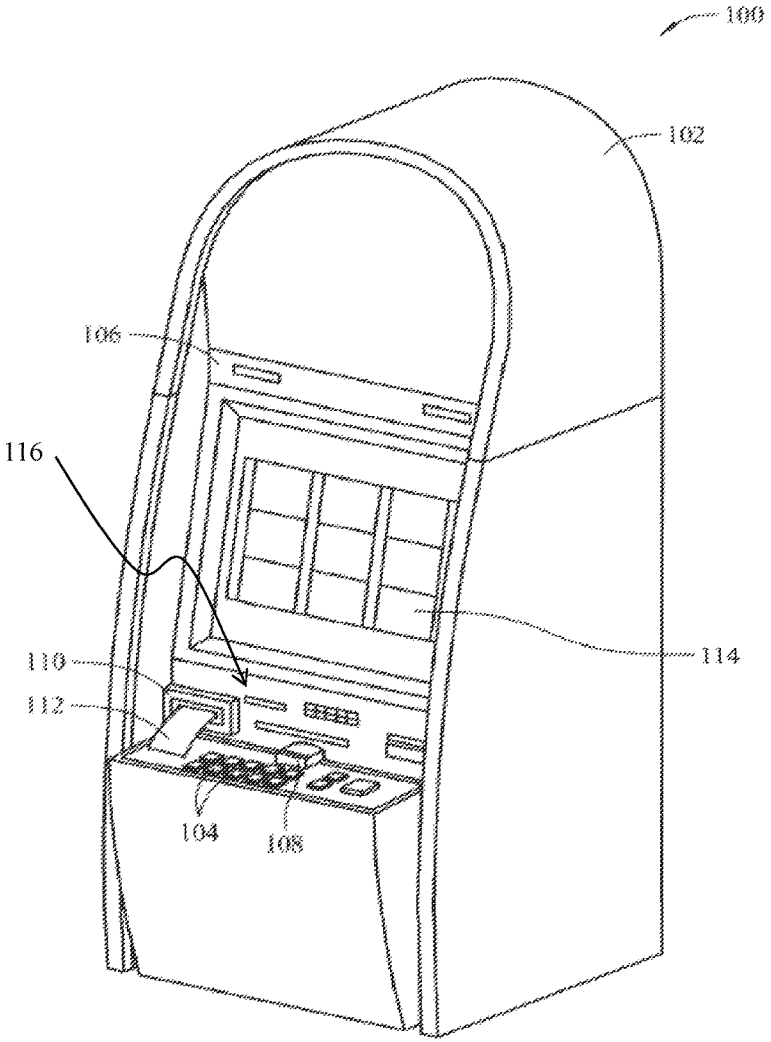
FIG. 1 is a schematic diagram of an exemplary gaming machine.

Class II games and Class III games are generally manufactured as distinct gaming machines. The Class II gaming machines, e.g., bingo-based gaming machines, typically connect to a central server that, for example, generates a random ball-call in bingo-based games. The results of the ball-call are then communicated to the bingo-based gaming machines via a network. Because the Class II game results are determined by the central server, Class II games are often referred to as centrally-determined games. The Class III gaming machines typically include a random number generator (RNG) that can generate its own game results and, in some instances, stands alone without a connection to a central game server. Because of Class III gaming machines' independence from a centralized game-result determination, Class III games are often referred to as non-centrally determined games. The distinctions between a given Class II game and a given Class III game generally go unnoticed by players. In some cases, the same game is even offered on both Class II and Class III gaming machines.

It is realized herein a unified gaming machine that is selectively configurable to present both Class II and Class III games in a single gaming machine would be cost effective for game manufacturers and casino operators. A given gaming machine, in certain embodiments, is either operated as a Class II game (centrally determined), or as a Class III game (non-centrally determined).

The boot process for a gaming machine begins with applying power and execution, by a processor, of the basic input/output system (BIOS) software that is typically stored in a first read-only memory (ROM). The BIOS initializes system hardware for the electronic gaming machine, such as memory (RAM, ROM, flash, disks, etc.) and peripheral devices, such as sound, display, and input devices. Once the BIOS completes initialization, the processor executes a boot strap code that is typically stored in a second ROM. The boot strap code authenticates and then copies the OS, OS drivers, and other gaming-specific applications into random access memory (RAM).

Once in RAM, the OS is executed by the processor and an anchor application is loaded from a mass storage device, such as a hard disk, flash drive, or other suitable memory. The anchor application is verified at load by a signature. The anchor application is then used to load all other applications, including various Class II and Class III games and game engines. Each application is authenticated by computing a respective signature and comparing it to a signature stored in mass storage for that application.

A signature for a given Class II or Class III game may be computed, for example, and without limitation, using a hash function to generate a message digest unique to the given game data set. The message digest is then encrypted using an encryption algorithm and encryption key to generate the signature. The signature is then stored in non-volatile memory along with the data set that defines the given Class II or Class III game.

When authentication of the game software is performed at load time, a message digest for the loaded game data set is computed and compared to the stored message digest. If the stored message digest and the computed message digest match, the game is authenticated and game play proceeds. Otherwise, the game is deemed corrupt or, at least, not-authentic.

Alternatively, the Class II game and the Class III game can be loaded, authenticated, and run concurrently at boot time to avoid subsequent lengthy delays in the accessing a given game, such as, for example, delays occurring while switching between a Class II and a Class III game. It is further realized herein the selection of Class II or Class III can be made manually or automatically. In certain embodiments, where manual conversion is utilized, non-transitory memory cartridges, or disks, are used to store the OS and the various Class II and Class III games, assets, Class II game engine, and the Class III game engine. A transition between Class II and Class III, or between Class III and Class II, is accomplished by physically changing the non-transitory memory cartridges. For example, to switch from Class II to Class III, a Class II cartridge is removed and a Class III cartridge is inserted. In certain embodiments, the Class II games, assets, and game engine are simply stored on a separate partition of a non-transitory memory from the Class III games, assets, and game engine.

It is realized herein, in certain embodiments, a manual transition between Class II and Class III may be carried out by manually loading the appropriate executable program modules, or by manually selecting one configuration.

In certain embodiments, the Class II game engine and the Class III game engine are implemented as Virtual Machines available for execution sequentially, alternately, or simultaneously. Selection of Class II or Class III amounts to a selection of one virtual machine over the other. In alternative embodiments, the Class II and Class III game engines are integrated into a single game engine that can run either Class II or Class III games. Such a unified game engine determines whether to invoke a ball-call or a random number generator, for example, based on the selection of Class II or Class III.

It is often the case that a gaming establishment, e.g., on an Indian reservation, will have a "cap," imposed by a tribal-state compact, on the number of Class III gaming machines that it can legally operate. Many gaming establishments have a limited number of gaining machines for playing Class III games and a greater number of gaming machines for playing Class II games, such as bingo. For example, a state may authorize up to 2,000 Class III gaming machines in a gaming establishment having 3,000 or more total gaming machines. Moreover, some gaming establishments have limited licenses for certain types of games for contractual reasons. It is realized herein a unified gaming machine can be selectively configured for either Class II or Class III gaming, while satisfying the regulator requirements for both types of gaming. For example, in certain embodiments, gaming machines enabled for Class II play include a network connection to a gaming server for centralized outcome determination. It is realized herein the transition between Class II and Class III may be implemented automatically as players join or leave games. In certain embodiments, the transition is carried out according to a predefined schedule that may be defined, for example, based on peak usage. In certain embodiments, the Class II engine and the Class III engine run concurrently, and the gaming machine uses one or the other to determine game outcomes based on the Class II or Class III game selection.

It is further realized herein a unified gaming machine may communicate with various non-gaming servers for both Class II and Class III games. For example, a unified gaming machine communicates with a player tracking server, a financial server, or a database server. These services are provided to unified gaming machines regardless of the Class II or Class III distinction. Consequently, a unified gaming machine may utilize a unified server for such non-gaming activities. For example, a unified player tracking server may be utilized. Similarly, a unified bonusing and progressive server may be utilized. In certain embodiments, a unified accounting system is utilized to accommodate differences in accounting rules and tax rules.

Exemplary technical effects of the systems, methods, and apparatus described herein include at least one of: (a) providing players and casino operators a choice between presenting a Class II game and a Class III game; (b) reducing cost of manufacturing distinct Class II and Class III gaming machines; (c) reducing downtime while transitioning between Class II and Class III games; and (d) reducing development costs of a given game for both Class II and Class III gaming machines.

FIG. 1 is a schematic diagram of an exemplary gaming machine 100. Gaming machine 100 may be any type of gaming machine, and may include, without limitation, different structures than those shown in FIG. 1, such as, for example, a personal computer, tablet computer, smart phone, personal digital assistant (PDA), cellular phone, and any other network-enabled device. Moreover, gaming machine 100 may employ different methods of operation than those described below. Gaming machine 100 may be configured as a Class II gaming machine or as a Class III gaming machine.

In the exemplary embodiment, gaming machine 100 includes a cabinet 102 that houses a plurality of components, such as a gaming machine controller, peripheral devices, displays, and/or player interaction devices. For example, in an exemplary embodiment, gaming machine 100 includes a plurality of user interfaces, or input devices, such as switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher that corresponds to a number of remaining credits. User interfaces, in certain embodiments, include one or more touch screens as user interfaces.

In the exemplary embodiment, gaming machine 100 also includes a credit input device 116. Credit input device 116 may include a coin acceptor 108 for accepting coins and/or tokens, a bill acceptor 110 for accepting and/or validating cash bills, coupons, and/or ticket vouchers 112. Bill acceptor 110 may also be capable of printing tickets 112. Furthermore, in some embodiments, credit input device 116 includes a card reader or a validator for use with credit cards, debit cards, identification cards, and/or smart cards. Cards accepted by the card reader or validator may include a magnetic strip and/or a preprogrammed microchip that includes a player's identification, credit totals, and any other relevant information that may be used. In certain embodiments, credit input device 116 may include a credit input module that interfaces with a server to accept credit and wagers.

Moreover, in the exemplary embodiment, gaming machine 100 includes one or more displays 114. Displays 114 are mounted to cabinet 102, and may include a primary display for displaying a primary game and a secondary display for displaying a secondary or bonus game. Displays 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user.

In one embodiment, display 114 displays a game presentation that includes one or more game presentation objects, game images, symbols, or indicia, such as a visual representation or exhibition of movement of an object (e.g., a mechanical, virtual, or video reel), dynamic lighting, video images, and the like. Display 114 may include touch screen capabilities as a user interface to facilitate player interaction with the game presentation.

Figure 2:
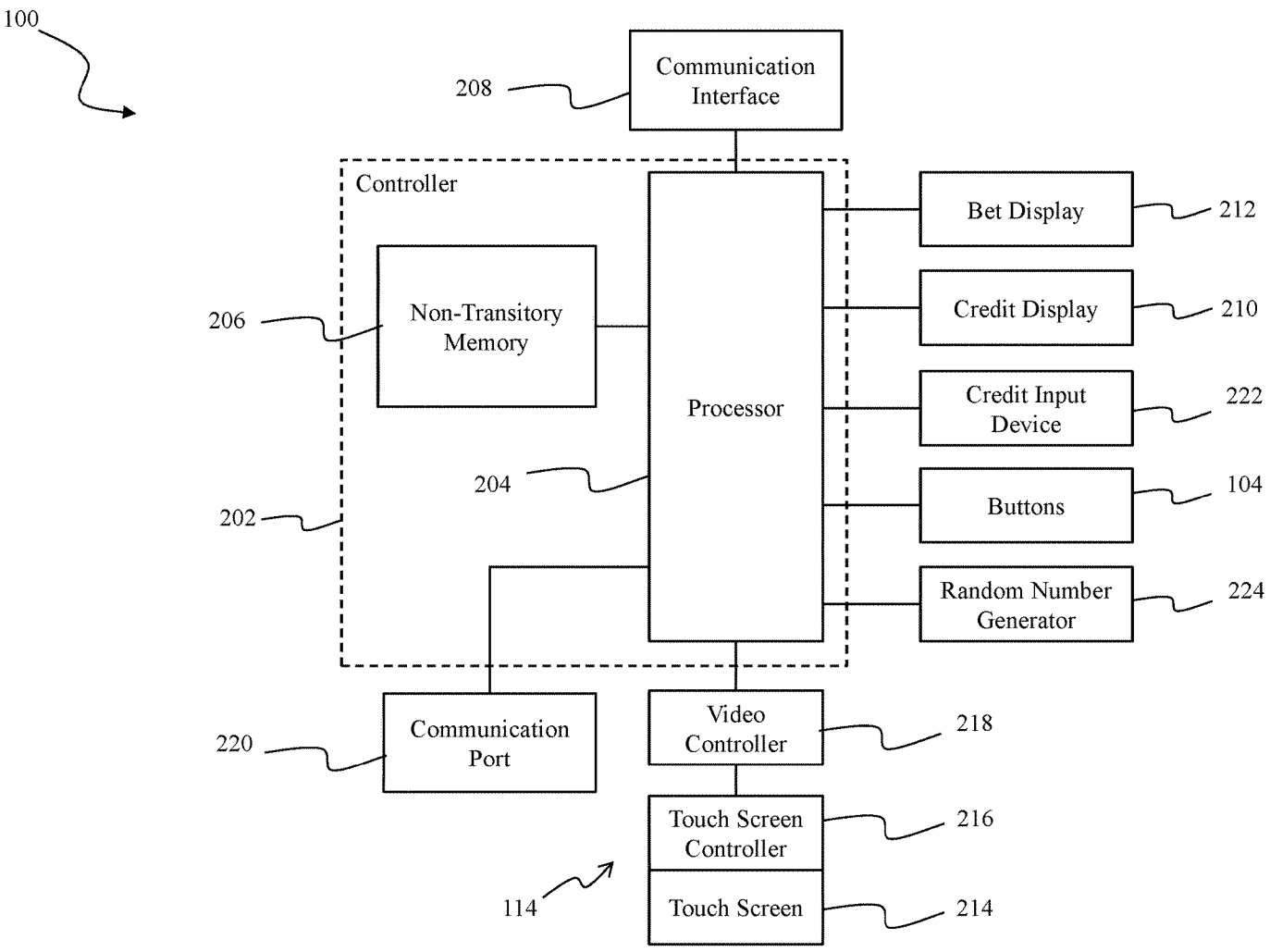
FIG. 2 is an exemplary block circuit diagram that may be used with the gaming machine shown in FIG. 1.

FIG. 2 is a schematic block diagram of gaming machine 100. In the exemplary embodiment, gaming machine 100 includes a gaming machine controller 202 having a processor 204 communicatively coupled to a non-transitory memory 206. Moreover, in the exemplary embodiment, processor 204 and non-transitory memory 206 reside within cabinet 102 (shown in FIG. 1) and may be collectively referred to herein as a "computer" or "controller." Gaming machine 100 is configurable and/or programmable to perform one or more operations described herein by programming processor 204. For example, processor 204 may be programmed by encoding an operation as one or more executable instructions and providing the executable instructions in non-transitory memory 206.

Controller 202 communicates with one or more other gaming machines 100 or other suitable devices via a communication interface 208. Communication interface 208 may operate as an input device (e.g., by receiving data from another device) and/or as an output device (e.g., by transmitting data to another device). Processor 204 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor." Gaming machine 100 includes a random number generator 224 for use in presenting Class III games. In certain embodiments, random number generator 224 is integrated into controller 202 or processor 204.

Figure 3:
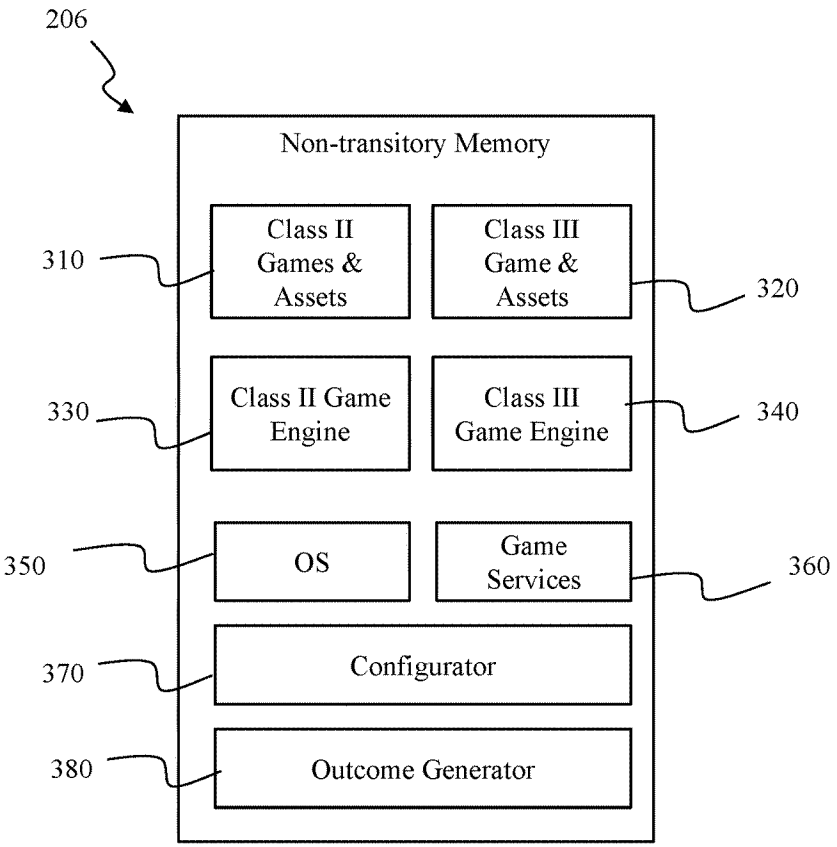
FIG. 3 is a block diagram of an exemplary non-transitory memory that may be used in the gaming machine shown in FIG. 1.

FIG. 3 is a block diagram of non-transitory memory 206, including one or more non-transitory memory devices that store program code and instructions, executable by processor 204, for controlling gaming machine 100. Non-transitory memory 206 includes various executable program modules, including Class II games and assets 310, Class III games and assets 320, a Class II game engine 330, a Class III game engine 340, an OS 350, game services 360, a configurator 370, and an outcome generator 380. Non-transitory memory 206 further includes at least one ROM (not shown) configured to store a BIOS for initializing gaming machine 100. Non-transitory memory 206 may be further configured to store a secure loader (not shown) for loading and authenticating Class II games and assets 310, Class III games and assets 320, Class II game engine 330, Class III game engine 340, OS 350, game services 360, configurator 370, outcome generator 380, and any other executable program module to be loaded, authenticated, and executed on gaming machine 100.

OS 350 may include any suitable operating system for presenting Class II and Class III games, such as, for example, Linux or Windows. Game services 360 include executable program modules and drivers for carrying out certain game functions and interfacing with various hardware of gaming machine 100, including, for example, cash in, ticket in, ticket out, meters accounting, and low level input/output.

Class II game engine 330 may include a game engine for games such as Bingo or Keno, or other Class II games. Class II game engine 330 for a Bingo, Bingo-based, or other centrally determined game includes game logic, display logic, card generation, ball call requests, bonus features, and progressives, for example. Additionally, game meters, including hardware meters and/or software meters, for games won, games lost, cash paid in, cash paid out, tickets received, tickets issued, and jackpot paid, among others, are kept for Class II games played. Each gaming jurisdiction in which the wagering game takes place has different rules to regulate play of Class II games. Consequently, Class II game meters are typically stored separately for accounting, tax, audit, and other jurisdictional control and monitoring purposes.

Class III game engine 340 may include a game engine for games such as slots, poker, blackjack, or roulette, or other Class III games. Class III game engine 340 includes game logic, a random number generator, display logic, bonus features, and progressives, for example. Additionally, game meters, including hardware meters and/or software meters, for games won, games lost, cash paid in, cash paid out, tickets received, tickets issued, and jackpot paid, among others, are kept for Class III games played. Each gaming jurisdiction in which the wagering game takes place has different rules to regulate play of Class III games. Consequently, Class II game meters are typically stored separately for accounting, tax, audit, and other jurisdictional control and monitoring purposes.

In embodiments where Class II and Class III games are both available for play concurrently, each set of meters is incremented independently. Such incrementing facilitates independent accounting. For example, revenue received for Class II game plays, which may be taxed at a different rate from Class III games, can be calculated for each different jurisdiction separately.

Configurator 370 controls configuration of gaming machine 100, as well as transitions between Class II and Class III operation. In certain embodiments, configurator 370 reads a configuration file to determine whether to boot gaming machine 100 as a Class II gaming machine or a Class III gaming machine. Once determined, OS 350 is loaded, followed by loading and authenticating the appropriate game engine, games, and assets. In alternative embodiments, configurator 370 causes both Class II and Class III game engines, games, and assets to be loaded concurrently, which avoids the boot process when transitioning between Class II and Class III games.

Non-transitory memory 206 is further configurable to store data such as image data, event data, player input data, random or pseudo-random number generation software, pay table data, trigger event conditions, game play events, a list of predefined periods of time to execute the game play events, game play outcomes, and/or other information or applicable game rules that relate to game play on gaming machine 100.

In certain embodiments, the data and the computer-executable instructions may be stored in a cloud service, a database, or other non-transitory memory accessible by gaming machine 100. Such embodiments reduce the computational and storage burden on gaming machine 100. As such, non-transitory memory 206 may be a local and/or a remote computer storage media including memory storage devices. Moreover, non-transitory memory 206 may include one or more forms of memory. For example, non-transitory memory 206 can include random access memory (RAM), read-only memory (ROM), flash memory, and/or electrically erasable programmable read-only memory (EEPROM). In some embodiments, other suitable magnetic, optical, and/or semiconductor-based memory may be included in non-transitory memory 206 by itself or in combination.

When Class II or Class III games are implemented in an online environment, at least a portion of the game software is stored in a remote game server, or in a cloud computing service. Game transactions such as adding money to the game, i.e., cash in, and withdrawing money from the game, i.e., cash out, are substituted by implementing electronic fund transfers. Each player deposits money into his online gaming account via checks, debit cards, wire and the like. Once funded, the player can move a portion of the cash in his account into the game he wants to play. This process is referred to as account-based wagering. Account-based wagering is a convenient monetary transaction system for online and mobile wagering environments since the physical bill acceptor and ticket printer are not available. In addition to the accounting meters' separation requirement, the detection of the location where the wagering transaction take place is also required in order to enforce local gaming regulations and to properly calculate revenue, profit, and tax withholdings, for example.

Non-transitory memory 206, in certain embodiments, is a physical storage device, such as, for example, a cartridge that is removable from gaming machine 100. Further, in certain embodiments, non-transitory memory 206 includes multiple removable physical storage devices, each configured to store certain executable program modules. For example, in one embodiment, non-transitory memory 206 includes a first cartridge for storing OS 350, a second cartridge for storing Class II games and assets 310 and Class II game engine 330, and a third cartridge for storing Class III game and assets 320 and Class III game engine 340. In alternative embodiments, non-transitory memory 206 includes multiple partitions of a single physical storage device, each partition configured to store certain executable program modules.

Referring again to FIG. 2, in the exemplary embodiment, gaming machine 100 includes a credit input device 222 for accepting various forms of money or credit. Credit input device 222 may include one or more of a coin acceptor, bill validator, ticket reader, or card reader, for example. In certain embodiments, credit input device 222 includes an interface to a server configured to accept credits to establish a credit balance at gaming machine 100.

Gaming machine 100 includes a credit display 210 that displays a player's current number of credits, cash, account balance or the equivalent. Gaming machine 100 also includes a bet display 212 that displays a player's amount wagered. Credit display 210 and bet display 212 may be standalone displays independent of display 114, or credit display 210 and bet display 212 may be incorporated into display 114.

Moreover, in an exemplary embodiment, display 114 is controlled by controller 202. In some embodiments, display 114 includes a touch screen 214 and an associated touch screen controller 216. In such embodiments, display 114 may operate as an input device in addition to presenting information. A video controller 218 is communicatively coupled to controller 202 and touch screen controller 216 to enable a player to input game play decisions (e.g., actions on and selections of game presentation objects) into gaming machine 100 via touch screen 214. Furthermore, gaming machine 100 includes one or more communication ports 220 that enable controller 202 to communicate with external peripheral devices (not shown) such as, but not limited to, external video sources, expansion buses, other displays, a SCSI port, or a key pad.

Figure 4:
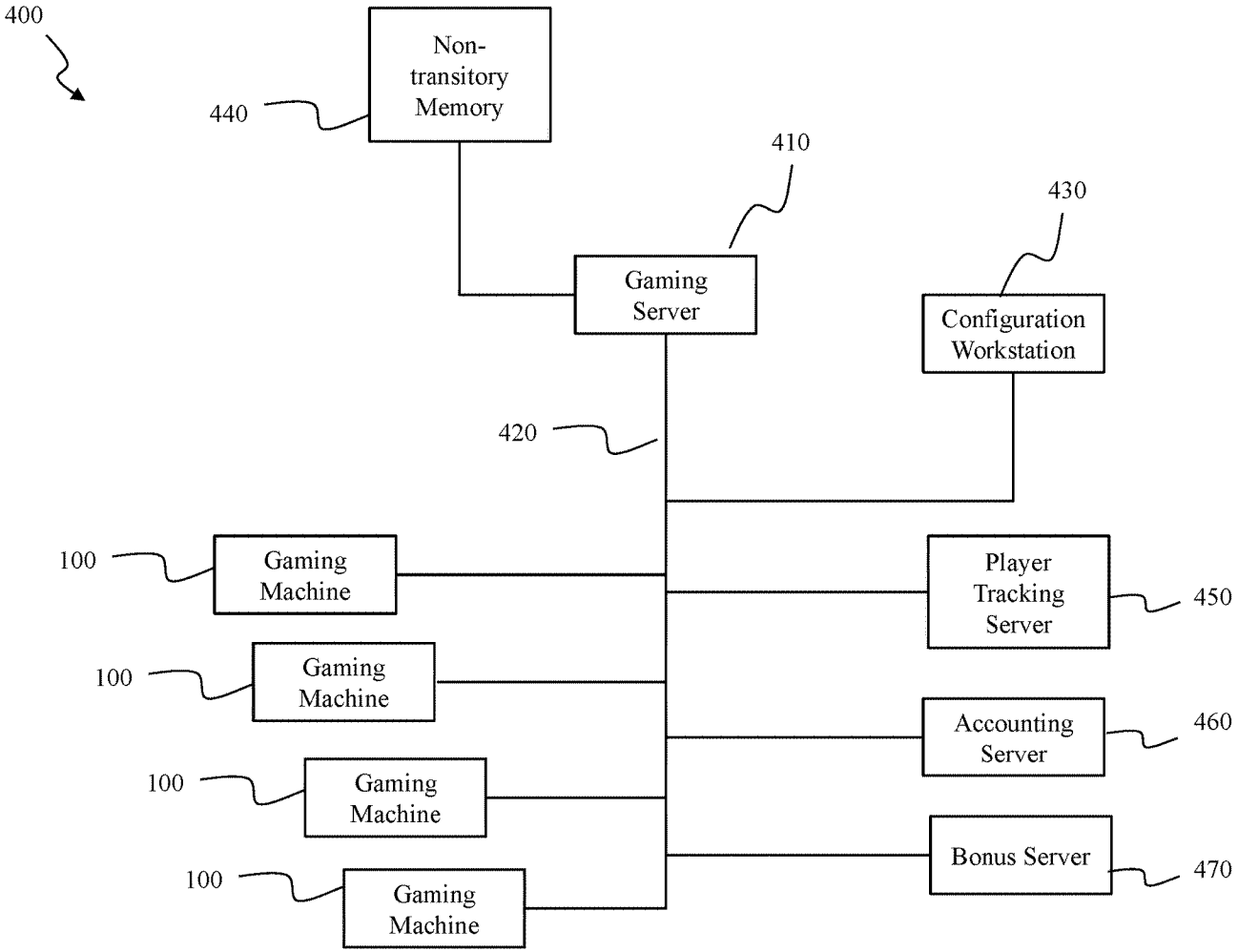
FIG. 4 is a block schematic diagram of an exemplary gaming system that includes a plurality of gaming machines such as the gaming machine shown in FIG. 1.

FIG. 4 is a block schematic diagram of an exemplary gaming system 400 that includes a plurality of gaming machines 100 (shown in FIG. 1). Each gaming machine 100 is coupled via communication interface 208 (shown in FIG. 2) to one or more servers, such as a gaming server 410, using a network 420. In certain embodiments, gaming system 400 may include a player tracking server 450, an accounting server 460, and a bonus server 470. Gaming server 410 may have an electrical architecture similar to that of gaming machine 100. Gaming server 410 includes a processor (not shown) and a network interface, such as communication port 220 that facilitates data communication between gaming server 410, each gaming machine 100, and other components of gaming system 400. Such data is stored in, for example, a non-transitory memory 440, such as a database, that is coupled to gaming server 410.

Gaming system 400 includes a configuration workstation 430 coupled to server 410 and gaming machines 100 through network 420. In certain embodiments, configuration workstation 430 is configured to initiate a transition of at least one gaming machine 100 from a Class II gaming machine to a Class III gaming machine, or from a Class III gaming machine to a Class II gaming machine. The transition may, in certain embodiments, be initiated according to a predetermined schedule. In certain embodiments, the transition is carried out upon manual initiation by an operator of configuration workstation 430.

In one embodiment, one or more gaming machines 100 may be remote gaming machines that access a casino via network 420. As such, a player is able to participate in a game of chance on a remote gaming machine. In such an embodiment, it will be understood that a player operating a remote gaming machine has virtual access to any casino coupled to network 420 and associated with gaming server 410. Gaming machines 100 may also be a personal computers coupled to the Internet via a virtual private network such that a player may participate in a game of chance, remotely. In other embodiments, the player may use a cell phone or other mobile devices (e.g., tablets, PDAs, laptops, and the like) coupled to a wired or wireless communication network to establish a connection with a particular casino. Moreover, gaming machines 100 may be terminal-based machines, wherein the actual games, including random number generation and/or outcome determination, are performed at gaming server 410. In such an embodiment, gaming machines 100 display results of a game via display 114 (shown in FIGS. 1 and 2).

In one embodiment, gaming server 410 performs a plurality of functions including, game outcome generation, player tracking functions, and/or accounting functions, to name a few. For example, gaming server 410 may track data of players using gaming machines 100. For example, gaming server 410 can store physical characteristics of players, such as, but not limited to, a gender of a player and an age of a player. Gaming server 410 can also track and store other data related to the players using player tracking identification, such as a player card. For example, gaming server 410 can store information about a player, such as loyalty points, player address, phone number, and/or any information that may be retrieved and transmitted to gaming machines 100. In some embodiments, gaming server 410 stores and tracks information such as, but not limited to, an average amount of a wager played at gaming machines 100, any funds a player may have in an account, as well as data relating to reportable events. However, in alternative embodiments, gaming system 400 may include a plurality of servers that separately perform these functions and/or any suitable function for use in a network-based gaming system.

For example, gaming server 410 may provide a bingo or centrally determined game to a player operating one of gaming machines 100. That is, server 410 may display a game presentation for the bingo game on display 114. The player initiates the bingo game by inserting an appropriate amount of money or tokens at coin acceptor 108 (shown in FIG. 1) or bill acceptor 110 (shown in FIG. 1) and then push a play button (for example, one of player input buttons 104. When the wager is received, server 410 enables the game presentation to proceed in simulating a contest or other game.

In certain embodiments, server 410 enables the game machine to present the player with a choice among two or more game presentation objects respectively associated with two or more bingo cards. The player selects one of the game presentation objects through the game machine, and the selection is received at server 410. Server 410 admits the corresponding bingo card to the bingo game and determines whether the player wins an award and/or additional credits based on an evaluation of the selected bingo card against a randomly-drawn ball call.

Figure 5:
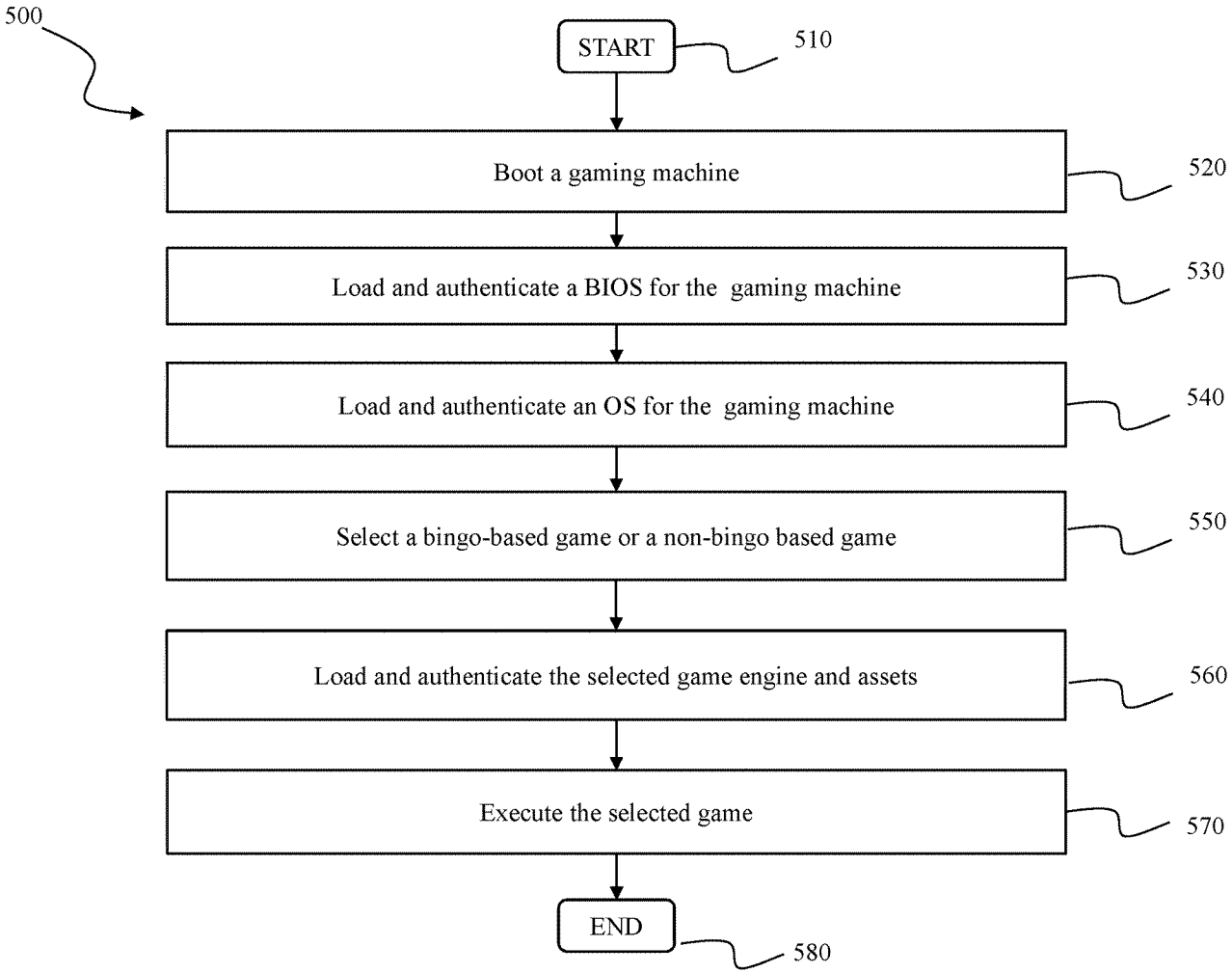
FIG. 5 is a flow diagram of an exemplary method of booting the gaming machine shown in FIG. 1.

FIG. 5 is a flow diagram of an exemplary method 500 of booting gaming machine 100 (shown in FIG. 1). Method 500 begins at a start step 510. At a boot step 520, gaming machine 100 is boot from non-transitory memory 206. At a BIOS step 530, a BIOS for gaming machine 100 is loaded and verified. At a OS step 540, an OS is loaded and verified on gaming machine 100.

At a selection step 550, a centrally determined game or a non-centrally determined game is selected to be presented on gaming machine 100. At a game engine step 560, a game engine and assets are loaded to gaming machine 100 and authenticated. If the centrally determined game is selected, a centrally determined game engine and assets are loaded and authenticated. If the non-centrally determined game is selected, a non-centrally determined game engine and assets are loaded and authenticated.

Once the game engine and assets are loaded and authenticated, the selected game is executed at an execution step 570. The method ends at an end step 580.

Figure 6:
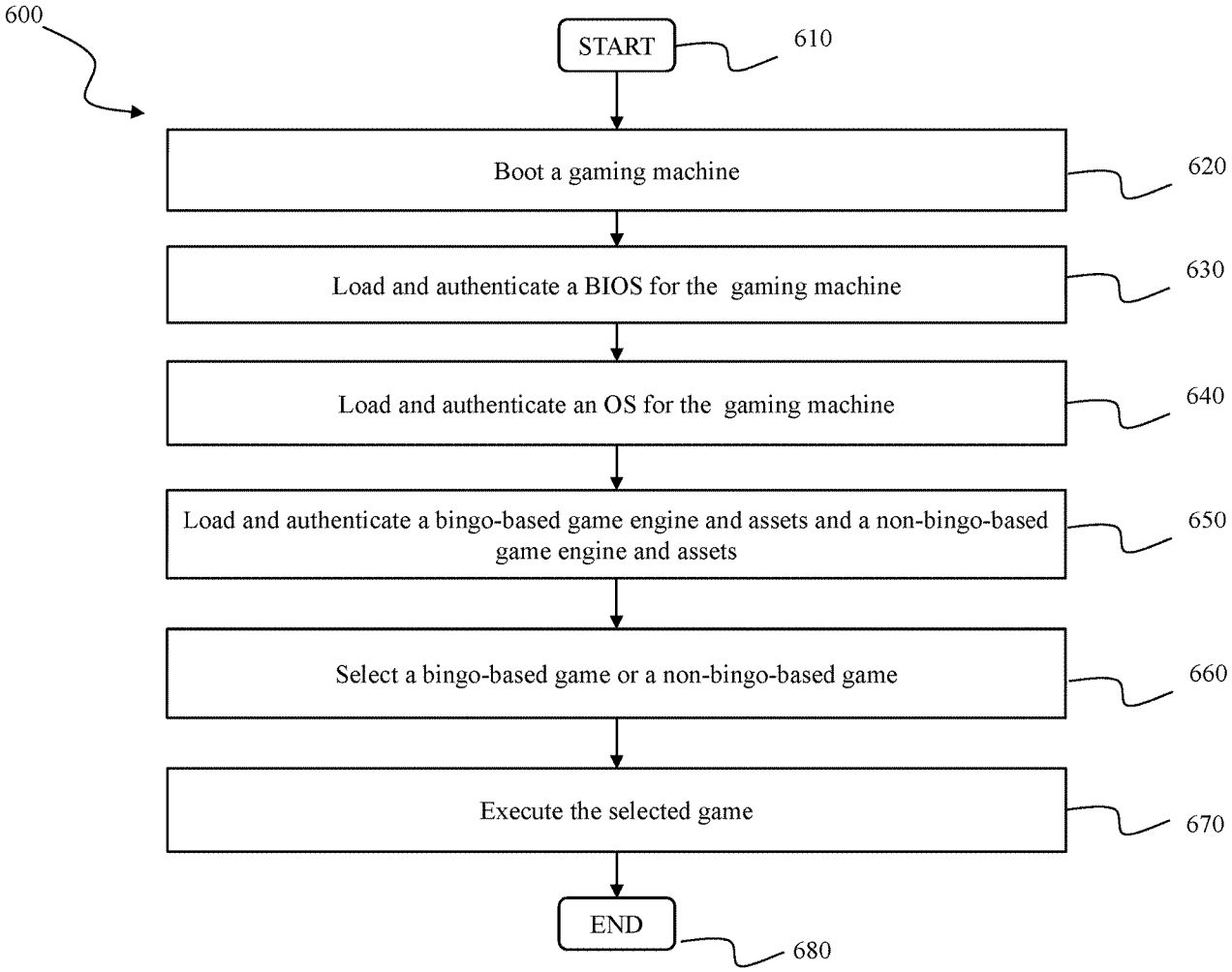
FIG. 6 is a flow diagram of an alternative method of booting the gaming machine shown in FIG. 1.

FIG. 6 is a flow diagram of an alternative method 600 of booting gaming machine 100 (shown in FIG. 1). Method 600 begins at a start step 610. At a boot step 620, gaming machine 100 is boot from non-transitory memory 206 (shown in FIGS. 2 and 3). At a BIOS step 630, a BIOS for gaming machine 100 is loaded and verified. At an OS step 640, an OS is loaded and verified on gaming machine 100.

At a selection step 650, a centrally determined game or a non-centrally determined game is selected to be presented on gaming machine 100.

At a loading step 650, a centrally determined game engine and a non-centrally determined game engine are loaded on gaming machine 100. Assets for the centrally determined game and assets for the non-centrally determined game are loaded and authenticated. At a selection step 660, a centrally determined game or a non-centrally determined game is selected to be presented on gaming machine 100. The selected game is executed at an execution step 670. The method ends at an end step 680.

Figure 7:
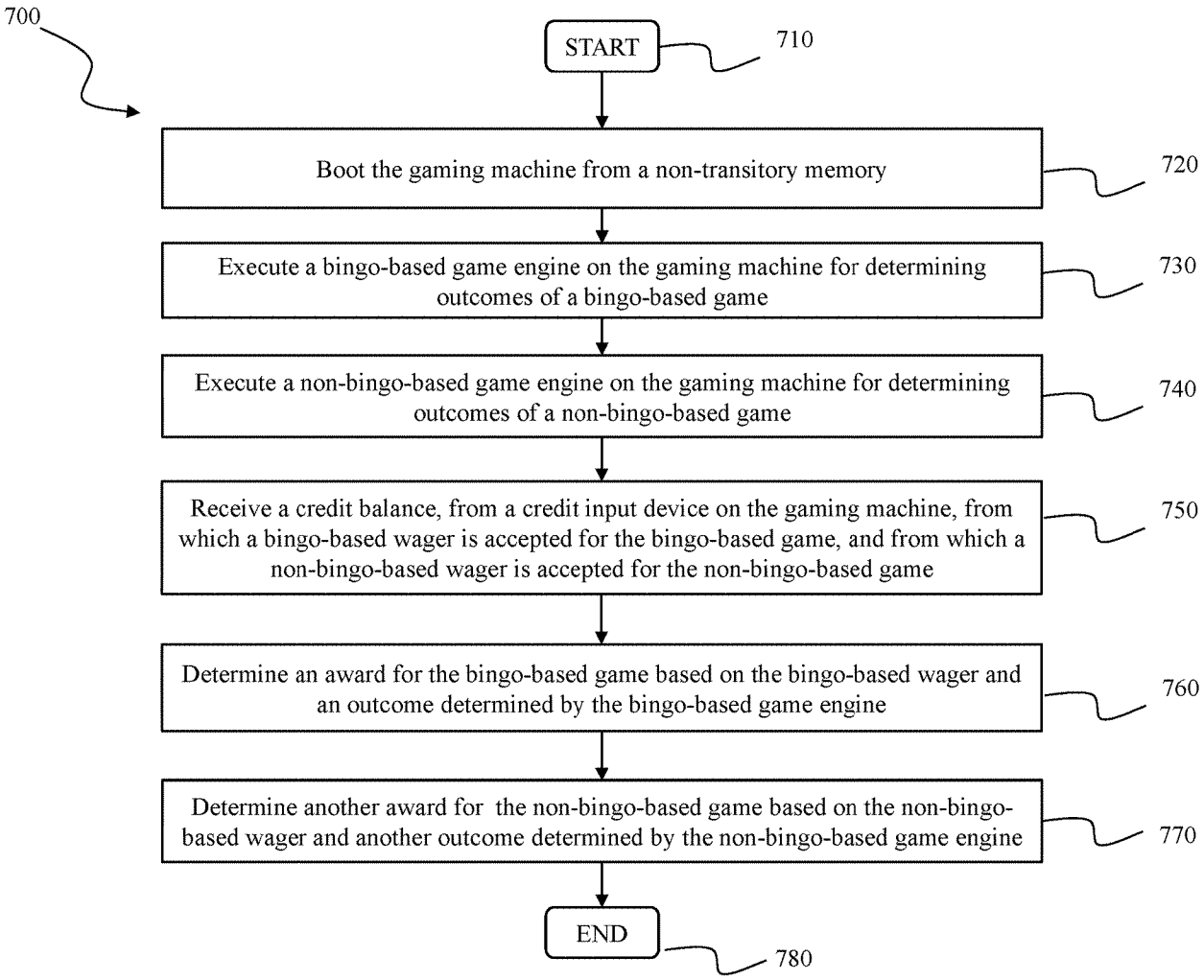
FIG. 7 is a flow diagram of an exemplary method of presenting a wagering game on the gaming machine shown in FIG. 1.

FIG. 7 is a flow diagram of an exemplary method 700 of presenting a wagering game on gaming machine 100.

Method 700 begins at a start step 710. At a boot step 720, gaming machine 100 is booted from non-transitory memory 206.

At an execution step 730, a centrally determined game engine is executed on the gaming machine. The centrally determined game engine is used to determine game outcomes for one or more centrally determined games. For example, in Bingo based games, the centrally determined game engine is configured to determine a game outcome for a particular bingo card based on a random ball-call. Such a centrally determined game engine may be configured to receive the ball-call from a remote gaming server.

At an execution step 740, a non-centrally determined game engine is executed on the gaming machine. The non-centrally determined game engine is used to determine game outcomes for one or more non-centrally determined games. For example, for a slot game, the non-centrally determined game engine uses a random number generator to generate reel stops and then determines the game outcome based on the symbols displayed.

Execution step 730 and execution step 740, in certain embodiments, are carried out concurrently on a single gaming machine. In alternative embodiments, execution step 730 and execution step 740 are carried out sequentially or alternately. For example, in one embodiment, execution of the centrally determined game engine is carried out until gaming machine 100 transitions from a centrally determined game to a non-centrally determined game. Execution of the non-centrally determined game engine is then carried out until gaming machine 100 transitions back to the centrally determined game.

At a receiving step 750, the gaming machine receives a credit balance from a credit input device. The credit input device may include a bill validator, a coin acceptor, a ticket reader, or a card reader, for example. Wagers are made using the credit balance. A centrally determined wager may be made from the credit balance for a centrally determined game. Likewise, a non-centrally determined wager may be made from the credit balance for a non-centrally determined game.

At an award step 760, the gaming machine determines an award for the centrally determined game based on the centrally determined wager and an outcome determined by the centrally determined game engine. Likewise, at an award step 770, the gaming machine determines an award for the non-centrally determined game based on the non-centrally determined wager and an outcome determined by the non-centrally determined game engine. Method 700 ends at and end step 780.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A game machine comprising:

a display device;

a credit input device through which a credit balance is established for wagering on a selected game;

a memory configured to store a Class II game and a Class III game; and a processor executing instructions which cause the processor to at least:

display, via the display device, a selection of at least one of the Class II game or the Class III game;

received, via a player input device, the selected game;

execute at least one of a first virtual machine for executing the Class II game and a second virtual machine for executing the Class III game;

execute the selected game using the first virtual machine for the Class II game or the second virtual machine for the Class III game, whereby the selected game is presented on the display device; and determine a game outcome for a play of the selected game.

2. The game machine of claim 1, wherein the instructions further cause the processor to execute the first virtual machine and the second virtual machine based on a configuration setting read from the memory during a boot of the game machine.

3. The game machine of claim 1, wherein the instructions further cause the processor to load assets corresponding to the selected game from the memory.

4. The game machine of claim 1, wherein the first virtual machine includes a ball-call module configured to communicatively couple to a game server that generates a random ball-call for determining a game outcome for a play of the Class II game.

5. The game machine of claim 1, wherein the memory is further configured to store a first meter associated with the Class II game and a second meter associated with the Class III game, and wherein the instructions further cause the processor to update one of the first meter and the second meter based on the selected game and the game outcome of the selected game.

6. The game machine of claim 1, wherein the instructions further cause the processor to load concurrently a first virtual machine for executing the Class II game and a second virtual machine for executing the Class III game.

7. A method of presenting a wagering game on a game machine, comprising:

booting, by a processor on the game machine, the game machine from a memory;

displaying, via a display device of the gaming machine, a selection of at least one of a Class II game or a Class III game;

received, via a player input device, the selected game;

executing, by the processor, at least one of a first virtual machine for executing the Class II game and a second virtual machine for executing the Class III game;

executing, by the processor, the selected game using the first virtual machine for the Class II game or the second virtual machine for the Class III game, whereby the selected game is presented on the display device; and determining, by the processor, a game outcome for a play of the selected game.

8. The method of claim 7 further comprising executing the first virtual machine and the second virtual machine based on a configuration setting read from the memory during booting of the game machine.

9. The method of claim 7 further comprising loading assets corresponding to the selected game from the memory.

10. The method of claim 7, wherein the first virtual machine includes a ball-call module configured to communicatively couple to a game server that generates a random ball-call for determining game outcomes for the Class II game.

11. The method of claim 7 further comprising:

storing, in the memory a first meter associated with the Class II game and a second meter associated with the Class III game; and updating one of the first meter and the second meter based on the selected game and the game outcome of the selected game.

12. The method of claim 7 further comprising loading concurrently a first virtual machine for executing the Class II game and a second virtual machine for executing the Class III game.

13. A game machine comprising:

a memory configured to store a Class II game and a Class III game; and a processor coupled to the memory and programmed to:

boot the game machine from the memory;

load, from the memory, the Class II game and the Class III game;

execute a selected game from the Class II game or the Class III game, whereby the selected game is presented on a display connected to the game machine; and determine a game outcome in response to a play of the selected game.

14. The game machine of claim 13, wherein the memory is further configured to store a signature for the Class II game, wherein the processor is further programmed to:

while loading the Class II game, generate a load signature for the Class II game;

compare the load signature and the stored signature for the Class II game; and authenticate the Class II game based on the comparison.

15. The game machine of claim 14, wherein the processor is further programmed to:

generate a message digest for the Class II game based on a hash function;

encrypt the message digest to generate the signature; and store, in the memory, the signature for the Class II game.

16. The game machine of claim 13, wherein the memory is further configured to store a signature for the Class III game, wherein the processor is further programmed to:

while loading the Class III game, generate a load signature for the Class III game;

compare the load signature and the stored signature for the Class III game; and authenticate the Class III game based on the comparison.

17. The game machine of claim 16, wherein the processor is further programmed to:

generate a message digest for the Class III game based on a hash function;

encrypt the message digest to generate the signature; and store, in the memory, the signature for the Class III game.

18. The game machine of claim 13, wherein the memory includes at least a first read-only memory (ROM), a second ROM, and a mass storage device, wherein the processor is further programmed to:

load and execute a basic input/output system from the first ROM;

load and execute boot strap code from the second ROM;

load and execute an anchor application from the mass storage device; and authenticate the anchor application based on a stored signature.

19. The game machine of claim 18, wherein the anchor application is configured to load the Class II game and the Class III game.

20. The game machine of claim 13, wherein the processor is further programmed to concurrently load a first virtual machine for executing the Class II game and a second virtual machine for executing the Class III game.

* * * * *